US011764460B2

(12) United States Patent
Zhao et al.

(10) Patent No.: US 11,764,460 B2
(45) Date of Patent: Sep. 19, 2023

(54) WEARABLE DEVICES

(71) Applicant: Anhui Huami Information Technology Co., Ltd., Anhui FTZ (CN)

(72) Inventors: Anping Zhao, Anhui FTZ (CN); Dehua Liu, Anhui FTZ (CN)

(73) Assignee: Anhui Huami Information Technology Co., Ltd., Anhui FTZ (CN)

( * ) Notice: Subject to any disclaimer, the term of this patent is extended or adjusted under 35 U.S.C. 154(b) by 0 days.

(21) Appl. No.: 17/990,461

(22) Filed: Nov. 18, 2022

(65) Prior Publication Data

US 2023/0082798 A1 Mar. 16, 2023

Related U.S. Application Data

(63) Continuation of application No. PCT/CN2021/098164, filed on Jun. 3, 2021.

(30) Foreign Application Priority Data

Jun. 5, 2020 (CN) ..... 202010506277.7
Jun. 5, 2020 (CN) ..... 202021019018.3

(51) Int. Cl.
*H01Q 1/27* (2006.01)
*G04G 17/04* (2006.01)
(Continued)

(52) U.S. Cl.
CPC ..... *H01Q 1/273* (2013.01); *G04G 17/04* (2013.01); *G04R 60/12* (2013.01); *H01Q 1/48* (2013.01); *H01Q 13/10* (2013.01)

(58) Field of Classification Search
CPC ... H01Q 1/273; H01Q 13/10; G04R 60/08–12
See application file for complete search history.

(56) References Cited

U.S. PATENT DOCUMENTS 7,079,079 B2 * 7/2006 Jo ..... H01Q 9/0421 343/702
9,979,426 B2 * 5/2018 Na ..... G04R 60/06
(Continued)

FOREIGN PATENT DOCUMENTS

CN 105785757 A 7/2016
CN 105789844 A 7/2016
(Continued)

OTHER PUBLICATIONS

International Search Report and English Translation for International Application No. PCT/CN2021/098164 dated Aug. 18, 2021.

*Primary Examiner* — Hasan Islam
(74) *Attorney, Agent, or Firm* — Young Basile Hanlon & MacFarlane, P.C.

(57) ABSTRACT

Provided are a wearable device, comprising: a metal frame, a gap between the metal frame and a mainboard of the wearable device forming an antenna of the wearable device; and a metal bezel, the metal bezel and the metal frame being electrically connected to each other through a plurality of connectors, a distance between any adjacent two of the connectors along a first direction being less than ¼ of a wavelength corresponding to a maximum operating frequency of one or more antennas of the wearable device, and the first direction being a peripheral direction of the metal frame.

19 Claims, 7 Drawing Sheets

(51) Int. Cl.

| | |
|---|---|
| ***G04R 60/12*** | (2013.01) |
| ***H01Q 1/48*** | (2006.01) |
| ***H01Q 13/10*** | (2006.01) |

(56) References Cited

U.S. PATENT DOCUMENTS

| | | | | |
|---|---|---|---|---|
| 10,871,751 | B2 * | 12/2020 | Yun | H01Q 9/0464 |
| 2012/0120772 | A1 | 5/2012 | Fujisawa | |
| 2016/0006109 | A1 * | 1/2016 | Apaydin | H01Q 13/18 343/702 |
| 2018/0062249 | A1 * | 3/2018 | Sung | H01Q 1/241 |
| 2018/0128924 | A1 * | 5/2018 | Wu | H01Q 1/38 |
| 2019/0245271 | A1 * | 8/2019 | Varjonen | H05K 7/1427 |

FOREIGN PATENT DOCUMENTS

| | | | |
|---|---|---|---|
| CN | 106486737 | A | 3/2017 |
| CN | 107799883 | A | 3/2018 |
| CN | 209860131 | U | 12/2019 |
| CN | 111613872 | A | 9/2020 |
| CN | 212412191 | U | 1/2021 |
| WO | 2016119172 | A1 | 8/2016 |

* cited by examiner

WEARABLE DEVICES

CROSS-REFERENCE TO RELATED APPLICATION(S)

The present application is a continuation of International Patent No. PCT/CN2021/098164, filed Jun. 3, 2021, which claims priority and benefit of Chinese Patent Application Nos. 202021019018.3 and 202010506277.7, both filed Jun. 5, 2020, the entire disclosures of all of which are hereby incorporated by reference.

TECHNICAL FIELD

The present disclosure relates to the field of electronics technologies, and in particular to a wearable device.

BACKGROUND

With the development of electronic devices, smart wearable devices are becoming more and more popular among users due to diverse functions thereof. Taking smart watches as an example, in addition to the basic timekeeping function, the smart watches generally integrate numerous functions such as motion assistance, trajectory positioning, connection with smart terminals, and phone calls. All these functions may be implemented by means of built-in antennas of the watches. Therefore, how to improve the antenna performance of the wearable devices has always been one of the most important research directions.

SUMMARY

Implementations of the present disclosure provide a wearable device.

In a first aspect, an implementation of the present disclosure provides a wearable device, comprising: a metal frame provided on a side of the wearable device, a gap between the metal frame and a mainboard of the wearable device forming an antenna of the wearable device; and a metal bezel provided on a front edge of the wearable device, the metal bezel and the metal frame being electrically connected to each other through a plurality of connectors, a distance between any adjacent two of the connectors along a first direction being less than ¼ of a wavelength corresponding to a maximum operating frequency of one or more antennas of the wearable device, and the first direction being a peripheral direction of the metal frame.

In some implementations, each of the metal frame and the metal bezel has an annular shape, the first direction is a circumferential direction of the metal frame, and the distance between two adjacent connectors along the first direction is a corresponding arc length between the two adjacent connectors.

In some implementations, the plurality of connectors are arranged uniformly along the first direction.

In some implementations, an insulating filler structure is filled between the metal frame and the metal bezel.

In some implementations, the one or more antennas of the wearable device comprise at least one of: a Bluetooth® antenna, a satellite positioning antenna, a WiFi antenna, an LTE antenna, or a 5G antenna.

In some implementations, an assembly step is provided on a side edge of the metal frame close to the metal bezel, a lug protruding toward the metal frame is formed on an edge of the metal bezel, and the metal bezel is provided on the assembly step of the metal frame through the lug.

In some implementations, each of the connectors is a metal spring piece, one end of the metal spring piece is fixed to the metal frame, and the other end of the metal spring piece abuts elastically against an inner wall of the lug of the metal bezel.

In some implementations, the metal frame is provided with a plurality of assembly holes, and the one end of the metal spring piece is fixed in a corresponding assembly hole.

In some implementations, the one end of the metal spring piece is welded to the metal frame.

In some implementations, each of the connectors is a snap integrally formed on the assembly step, and a protrusion that abuts against an inner wall of the lug is formed on a side of the snap facing the lug of the metal bezel.

In some implementations, the wearable device is a smart watch or a smart wristband.

The wearable device according to the implementations of the present disclosure comprises the metal frame and the metal bezel. The metal frame is disposed around the side of the device, and the gap between the metal frame and the mainboard of the wearable device forms the antenna of the wearable device, while the metal bezel is disposed around the front edge of the device, and the metal bezel and the metal frame are electrically connected to each other through the plurality of connectors, such that the bezel may be electrically connected to the frame at predetermined positions to improve the consistency of the antenna, and the performance of the antenna may not be affected even if some additional electrical contact points are created between the frame and the bezel at uncertain positions during use of the wearable device. Moreover, the distance between any two adjacent connectors along the first direction is less than ¼ of the wavelength corresponding to the maximum operating frequency of the one or more antennas. Since the length of the gap for generating electromagnetic wave resonance is required to be at least ¼ of the resonant wavelength, if the distance between any two adjacent connectors is less than ¼ of the wavelength corresponding to the maximum operating frequency of the antennas, clutter interference can be effectively avoided and the radiation performance of the antenna can be greatly improved.

BRIEF DESCRIPTION OF DRAWINGS

In order to explain detailed description of the present disclosure or technical solutions more clearly, the drawings to be used in the detailed description will be briefly introduced below. It is apparent that the drawings in the following description illustrate some implementations of the present disclosure. For those ordinary skilled in the art, other drawings may be obtained from these drawings without any creative efforts.

DETAILED DESCRIPTION

Implementations of the present disclosure will be clearly and completely described below with reference to the accompanying drawings. It is apparent that the described implementations are part of the implementations of the present disclosure, rather than all of the implementations. All other implementations obtained by those ordinary skilled in the art based on the implementations of the present disclosure without any creative efforts shall fall within the protection scope of the present disclosure. In addition, technical features involved in different implementations of the present disclosure described below may be combined with each other as long as they do not conflict with each other.

A wearable device according to the implementations of the present disclosure is applicable to any type of device suitable for implementation, for example, a wrist-worn device such as a smart watch or a smart wristband; a head-mounted device such as smart glasses or smart earphones; and a wearable device such as smart clothing; etc.

For the sake of illustration, the wearable device is exemplified hereinafter as a smart watch. However, it should be understood that the following implementations are also applicable to other types of wearable devices, which are not limited in the present disclosure.

Nowadays, if people want to purchase a smart watch, in addition to the function of the watch, an appearance of the watch is an important consideration. Therefore, how to improve the texture and aesthetics of the appearance of the watch has always been one of the key research directions for manufacturers. In order to increase the texture of the smart watch, metal materials such as alloy or stainless steel have been widely used in the appearance design of the watch. For example, most smart watches adopt the design of a metal middle frame, which also serves as an antenna radiator. In addition, from the perspective of the appearance design, if a metal bezel is separated from the top of the metal middle frame, the metal bezel may be colored and scaled differently from the metal middle frame, and a black edge of a screen may be covered to achieve a beautiful and cool appearance and improve the level of the device. Therefore, more and more metal materials are being added to a case of the smart watch.

Figure 1:
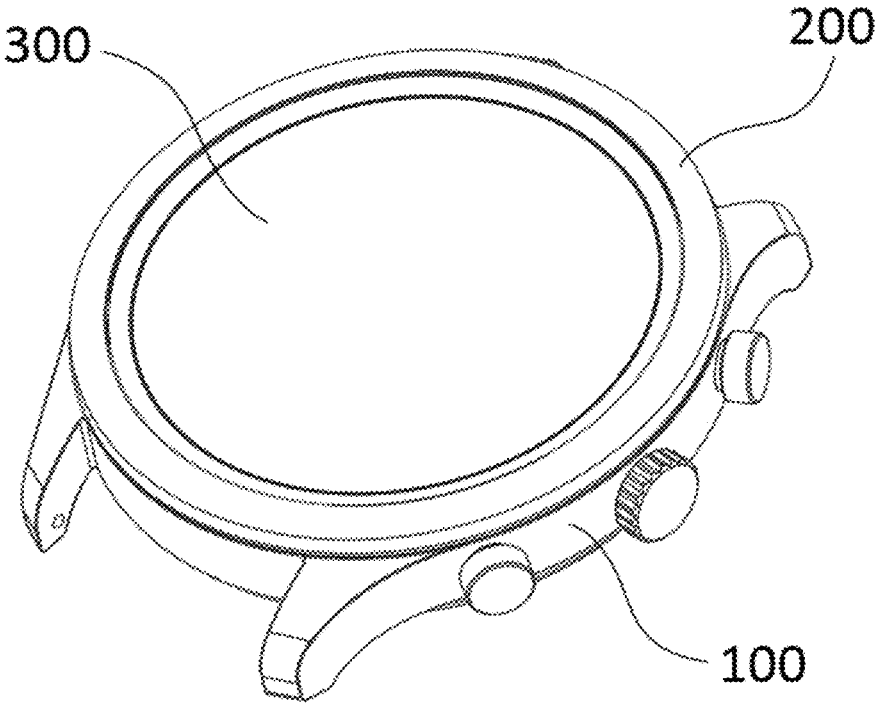
FIG. 1 is a schematic structural diagram illustrating an example smart watch.
Figure 2:
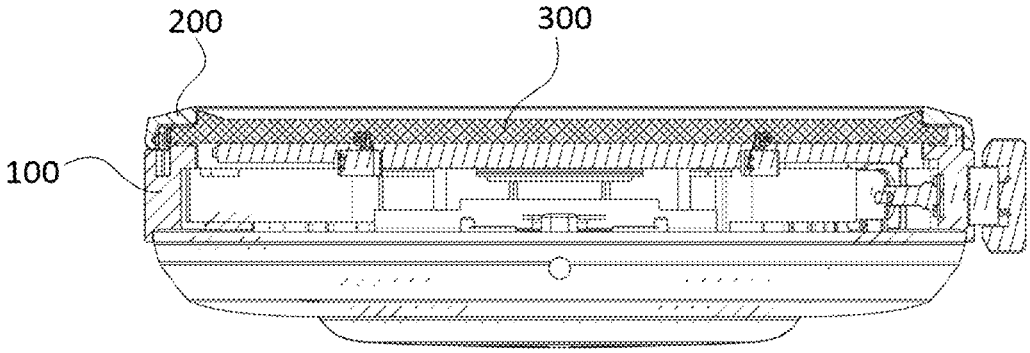
FIG. 2 is a schematic diagram illustrating a cross-sectional structure of the smart watch in FIG. 1.

FIGS. 1 and 2 illustrate a structure of an example smart watch. As shown in FIG. 1, an exterior portion of the smart watch includes a metal frame 100 and a metal bezel 200. The metal frame 100 is an annular metal middle frame, which is disposed around a side of the watch. In the smart watch, the metal frame 100 not only serves as a case structure of the watch, but also forms a slot antenna structure with a mainboard of the watch.

In particular, as for the smart watches, many of their functions need to be implemented by means of antennas. For example, functions such as Bluetooth®, satellite positioning, WiFi, and phone calls need to be implemented by radiating electromagnetic wave signals by built-in antennas. As for a smart watch with a metal middle frame, its antenna structure is generally formed by using a gap between the metal frame 100 and the mainboard of the watch. The metal middle frame is provided with a grounding point and connected to a feeding module on the mainboard, such that a corresponding antenna structure is formed.

As an assembly structure on a front surface of the smart watch, the metal bezel 200 mainly plays two roles in the smart watch.

As shown in FIG. 2, a screen 300 may be fixedly assembled with the metal frame 100 by means of a step, while a portion of the step supporting an edge of the screen 300 cannot be used as a display area and appears as a "black edge" in the appearance of the watch. In the pursuit of an extreme screen-to-body ratio today, the "black edge" is undoubtedly unacceptable to users, and manufacturers are committed to removing the "black edge". By providing the metal bezel 200 at the position of the "black edge", the "black edge" may be covered by a metal exterior, which greatly improves the texture of the appearance and enhances the user experience.

In addition, the metal bezel 200, as an annular outer ring of the watch, is provided with a variety of functions thereon, such as, for example, adding a time scale as an indicator scale of the watch; adding various ruler-type scales as additional functions of the watch; and providing various decorative structures and patterns as the appearance of the watch.

On the basis of the roles of the metal bezel, more and more smart watches are provided with the metal bezels on the front, and the metal bezel 200 is fixedly connected with the metal frame 100 by filling an adhesive between the metal bezel 200 and the metal frame 100. However, in actual use, such smart watches with the metal bezel 200 are found to have poor antenna consistency and performance. Through further research, it is discovered that this is due to that for the antenna structure, the metal frame 100 and the metal bezel 200 are two individual metal parts, and a small gap with a certain size, which is generally between 0.025 mm and 0.1 mm, exists between the two metal parts after assembly. Although the gap is electrically isolated by filling the gap with a dielectric material such as an adhesive, during the actual use of the watch, for example, when a portion of the metal bezel 200 is squeezed, the metal bezel 200 contacts with the metal frame 100 electrically at a single point or multiple points in unfixed positions. The electrical contact at a single point and the electrical contact at multiple points with a large spacing damage the original antenna performance, thereby affecting the function of the whole watch system.

Figure 3:
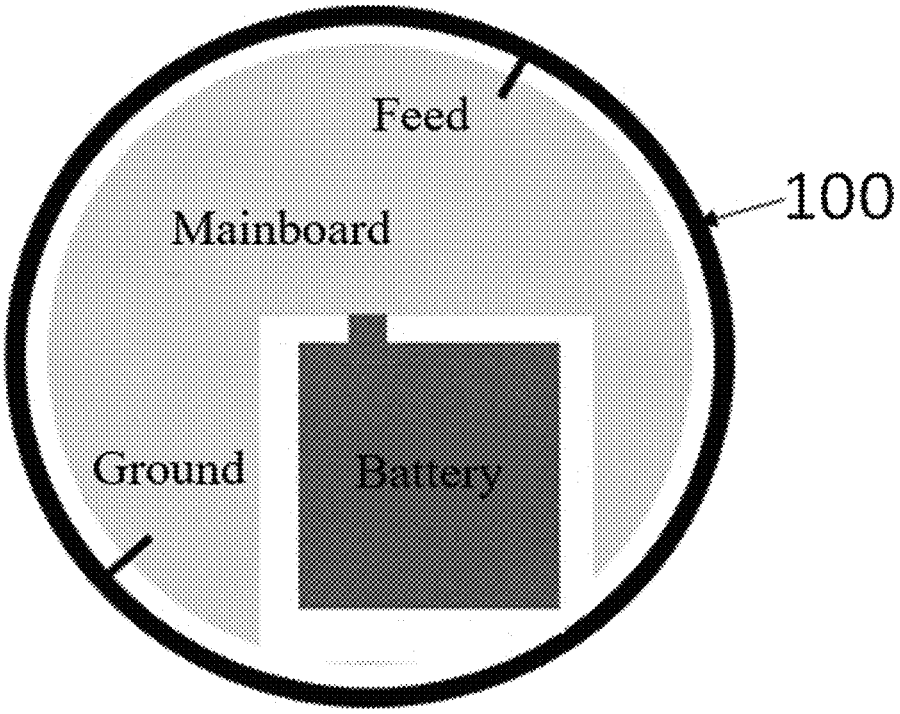
FIG. 3 is a schematic structural diagram illustrating a reference antenna.

A detailed description will be provided below in conjunction with test results in an example. For the sake of explanation, the antenna structure in this example is referred to as "reference antenna". An antenna with a relatively broad band is selected as the reference antenna with a structure shown in FIG. 3. That is, this antenna structure is implemented by the gap between the metal frame 100 and the mainboard in the watch. Those skilled in the art may understand this antenna structure and its operating principle, which will not be repeated herein.

Figure 4:
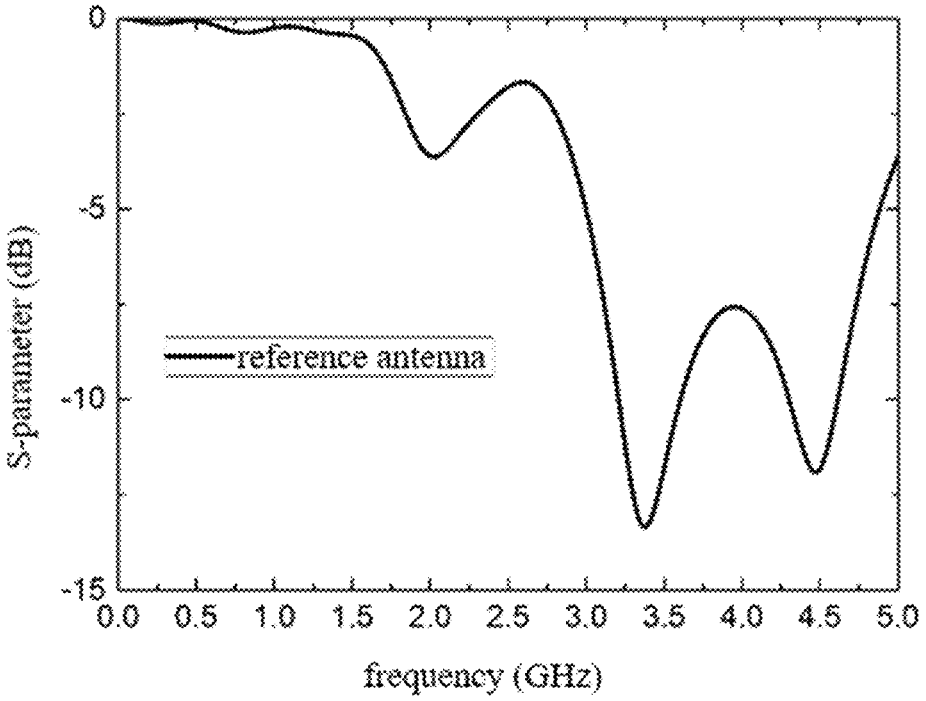
FIG. 4 is a graph illustrating a return loss of a reference antenna.

FIG. 4 illustrates a graph of a return loss (S-parameter) of the reference antenna without providing the metal bezel 200.

Figure 5:
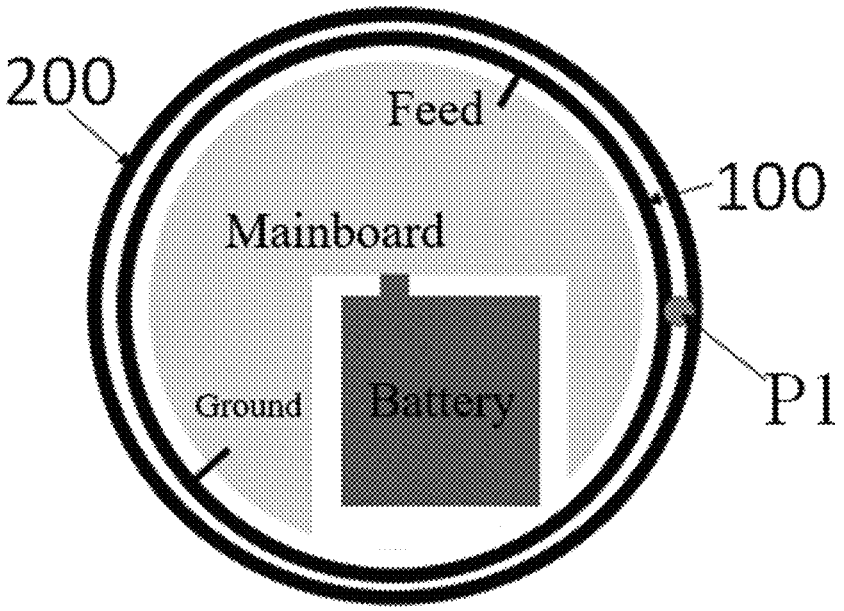
FIG. 5 is a schematic structural diagram illustrating a reference antenna with one electrical connection point between a metal frame and a metal bezel.
Figure 6:
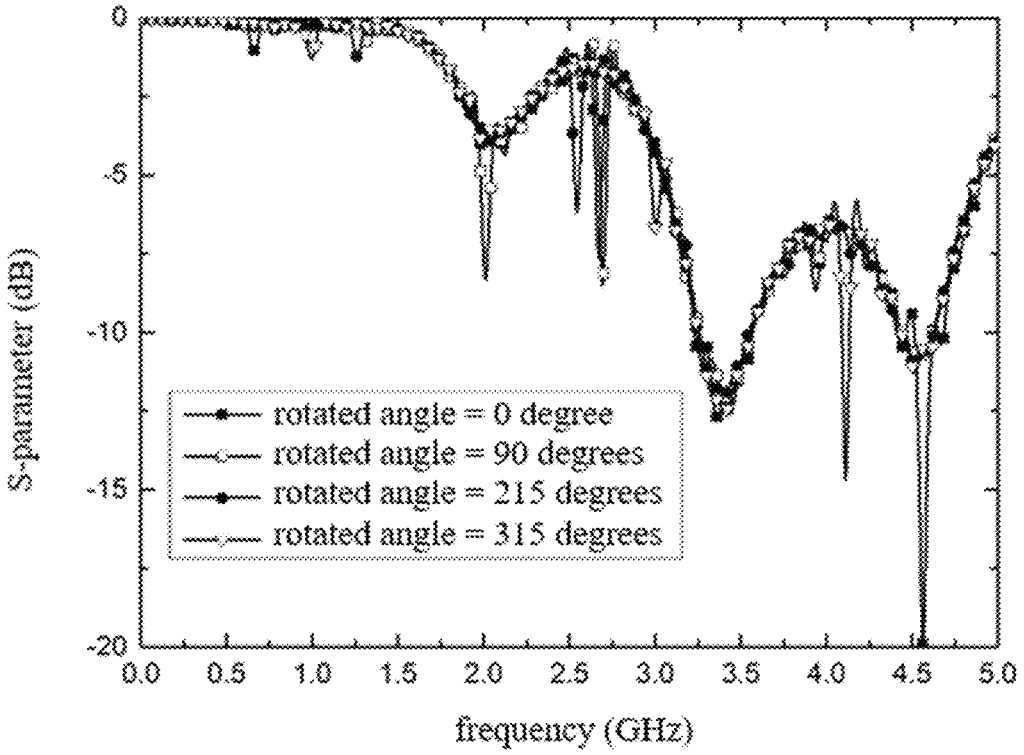
FIG. 6 is a graph illustrating a return loss of a reference antenna in case of FIG. 5.

Considering that in the actual use of the watch, the position where the metal bezel 200 is in electrical contact with the metal frame 100 is uncertain, it is assumed herein that an electrical contact point P1 is created between the metal bezel 200 and the metal frame 100 at the "three o'clock" position, as shown in FIG. 5. For the sake of generality, the electrical contact point P1 is rotated clockwise by different angles of 0°, 90°, 215°, and 315°. FIG. 6 illustrates a graph of a return loss of the reference antenna with the rotation of the electrical contact point P1 between the metal bezel 200 and the metal frame 100.

As can be seen from FIG. 6, the return loss of the reference antenna varies greatly with the position of the electrical contact point P1, and a lot of clutter may appear at multiple positions throughout the whole range of the frequency band, and the position of the clutter may change with the position of the electrical contact point P1. It can be known from the test results that the consistency and performance of the antenna cannot be guaranteed due to the uncertainty of the electrical contact point, which undoubtedly greatly affects the function of the antenna system of the watch.

Implementations of the present disclosure provide a wearable device. According to the technical solution of the present disclosure, the metal frame 100 and the metal bezel 200 are electrically connected to each other through a plurality of connectors, such that the bezel is electrically connected to the frame at predetermined positions, and the number and positions of electrical connection points are optimized to improve the consistency and performance of the antenna. Even if some additional electrical contact points are created between the frame and the bezel at uncertain positions during use, the performance of the antenna is not affected.

In some implementations, the wearable device can be shown by the example smart watch shown in FIG. 1. The smart watch includes an annular metal frame 100 and an annular metal bezel 200. The metal frame 100 is disposed around a side of the watch and serves as an antenna radiator, and a gap between the metal frame 100 and a mainboard of the wearable device forms an antenna of the wearable device. The metal bezel 200 is disposed around a front edge of the watch, and the metal bezel 200 is electrically connected to the metal frame 100 through a plurality of connectors. A distance between any adjacent two of the plurality of connectors along a first direction is less than ¼ of a wavelength corresponding to a maximum operating frequency of one or more antennas, the first direction being a direction around the metal frame 100, i.e., the first direction being a peripheral direction of the metal frame 100.

It is worth noting that in these implementations, the connectors serve to enable the metal bezel 200 and the metal frame 100 to be electrically connected at positions where the connectors are provided. For example, the connector may be a metal sheet provided in the gap between the metal bezel 200 and the metal frame 100. The specific structure and implementation of the connector will be described in detail in the following implementations, and will not be discussed herein.

As for the term "¼ of the wavelength corresponding to the maximum operating frequency of the one or more antennas", the watch often includes a plurality of antennas with different electromagnetic wave operating frequencies, such as Bluetooth antenna and satellite positioning antenna, and the term "the wavelength corresponding to the maximum operating frequency" refers to a wavelength of the antenna having the maximum operating frequency among these antennas. This will be described in detail below, and will not be discussed herein.

The term "first direction" is the peripheral direction of the metal frame 100. For example, as shown in FIG. 1, the "first direction" is a circumferential direction of the metal frame 100, and the term "distance along the first direction" refers to an arc length of a surface of the metal frame 100 where the connectors are provided. However, the same is true for frames with other shapes, such as rectangle, diamond, triangle, or other irregular shapes, which can be understood by those skilled in the art.

As can be seen from the above, with the wearable device according to the implementations of the present disclosure, the metal bezel 200 and the metal frame 100 are electrically connected to each other through the plurality of connectors provided between the metal bezel 200 and the metal frame 100, such that the metal bezel 200 is electrically connected to the metal frame 100 at predetermined positions to ensure the consistency of the antenna, and the performance of the antenna is not affected even if some additional electrical contact points are created between the metal frame 100 and the metal bezel 200 at uncertain positions during use. Moreover, the distance between any two adjacent connectors along the first direction is less than ¼ of the wavelength corresponding to the maximum operating frequency of the one or more antennas. Since the length of the gap for generating electromagnetic wave resonance is required to be at least ¼ of the resonant wavelength, if the distance between any two adjacent connectors is less than ¼ of the wavelength corresponding to the maximum operating frequency of the antennas, clutter interference can be effectively avoided and the radiation performance of the antenna can be greatly improved.

In particular, in order to achieve the above, the design of the wearable device according to the present disclosure mainly includes two parts: first, the number and position distribution of electrical connection points (i.e., the connectors); and second, a specific structure for realizing the electrical connection. These two parts will be described in detail below in conjunction with an example implementation.

Based on the operating principle of the slot antenna, the basic requirement for the slot antenna to produce the operating resonance is that the length of the gap is at least ¼ of the resonant wavelength, such as a ¼ wavelength slot antenna with one end open, and a ½ wavelength slot antenna.

The operating frequency f and the wavelength λ of the antenna satisfy the following relationship:

$$f = \frac{C}{\lambda}$$

where C refers to light speed. As can be seen, the higher the operating frequency f is, the smaller the wavelength λ is, and the smaller the required gap length is. In other words, among the plurality of antennas in the watch, as long as no clutter is produced for the antenna with the maximum operating frequency, the requirements for the antennas with other operating frequencies can be met.

It can be known based on the above that the arc length of the gap formed between two adjacent connectors should be guaranteed to be less than ¼ of the wavelength corresponding to the maximum operating frequency of the antennas.

In an example, if the plurality of connectors are not uniformly distributed along the first direction, i.e., the circumferential direction, the maximum arc length among the arc lengths of the gaps formed between two adjacent connectors should be guaranteed to be less than ¼ of the wavelength corresponding to the maximum operating frequency of the antennas.

In another example, if the plurality of connectors are uniformly distributed along the first direction, the arc length of each of the gaps should be guaranteed to be less than ¼ of the wavelength corresponding to the maximum operating frequency of the antennas.

The most reasonable distribution form of electrical connection for the antenna performance is uniform distribution. Therefore, in this implementation, the plurality of connectors are uniformly distributed along the first direction. As a result, the number of the connectors may be determined based on a diameter or circumference of the watch.

Figure 7:
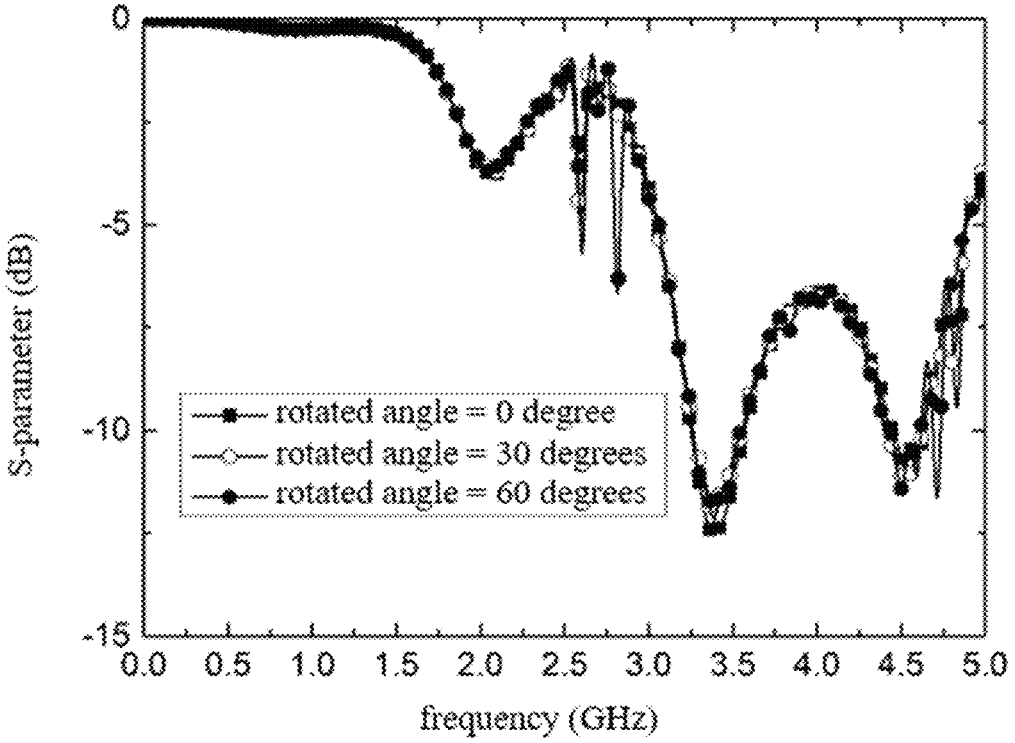
FIG. 7 is a graph illustrating a return loss of a reference antenna with four electrical connection points between a metal frame and a metal bezel.

According to some implementations, in an example as shown by the example smart watch of FIG. 1, the number of the connectors is set to four, and the four connectors are uniformly distributed along the circumferential direction. FIG. 7 illustrates a graph of a return loss of the antenna in this example. For the sake of generality, the four connectors are rotated clockwise by different angles of 0°, 30°, and 60° to obtain the graph as shown in FIG. 7.

It can be seen from FIG. 7 that, compared with the case of one electrical connection point in FIG. 6, since the arc length between two adjacent connectors is effectively reduced in case of four connectors, the clutter only appears in the range of frequency greater than 2.3 GHz, while the antenna has good consistency and performance in the range of frequency lower than 2.3 GHz.

Although the example in FIG. 7 can improve the consistency and performance of the antenna in the range of operating frequency lower than 2.3 GHz, it is not sufficient for the design of the smart watch.

By way of example, the smart watch generally includes a Bluetooth antenna, a WiFi antenna, and a satellite positioning antenna. A central operating frequency of the Bluetooth antenna and WiFi antenna is 2.4 GHz, and the central operating frequency of the satellite positioning antenna (GPS antenna) for general civil use is 1.575 GHz. For the Bluetooth antenna having the maximum operating frequency, its wavelength in the air is about 125 mm, and ¼ of the wavelength is about 30 mm. For a watch with a maximum diameter of 50 mm, in the case that the four connectors are uniformly distributed, the arc length between two adjacent connectors is about 40 mm. That is, the distance between two adjacent connectors is 40 mm, which is greater than ¼ of the wavelength corresponding to the maximum operating frequency, i.e., 30 mm. Therefore, clutter may still be produced for the Bluetooth and WiFi antennas with the frequency of 2.4 GHz.

Therefore, in the implementations of the present disclosure, the arc length between two adjacent connectors needs to be less than ¼ of the wavelength corresponding to the maximum operating frequency. For instance, in the above example, as long as the arc length between two adjacent connectors is less than 30 mm, it is guaranteed that the antenna has better consistency and performance in the range of the frequency lower than 2.4 GHz. That is, at least six connectors are arranged around the circumference of the metal frame 100. In the case that the six connectors are uniformly arranged, the arc length between two adjacent connectors is about 26 mm, which can fully meet the requirements.

It is worth noting that though a larger number of connectors may improve the consistency of the antenna, too many connectors may further increase the structural complexity and the impedance of the radiator. Therefore, in some preferred implementations, the minimum number of connectors that satisfy the above conditions are provided.

The implementation with six connectors uniformly distributed will be discussed further below. For the sake of generality, the six connectors are rotated clockwise by different angles of 0°, 20°, and 40° to obtain the graph of the return loss as shown in FIG. 8.

Figure 8:
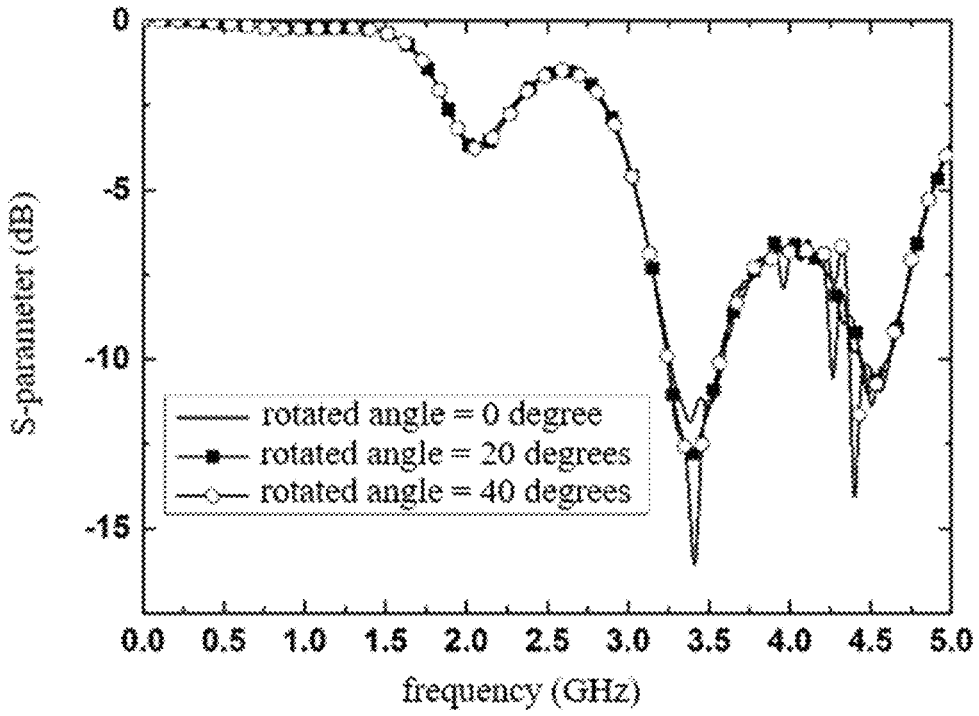
FIG. 8 is a graph illustrating a return loss of a reference antenna with six electrical connection points between a metal frame and a metal bezel.

As can be seen from FIG. 8, compared with the implementation in FIG. 7 with the four connectors, in case of six connectors, the clutter only appears in the range of frequency greater than 3.2 GHz, while the antenna has better consistency and performance in the range of frequency lower than 3.2 GHz. As for the smart watch, good performance in the range of frequency below 3.2 GHz is sufficient to meet the design requirements of the 2.4 GHz Bluetooth antenna.

It is worth noting that as can be seen from the above, the metal frame 100 and the metal bezel 200 are electrically connected by means of the connectors in this implementation. In a general state, the distance between two adjacent connectors has already met the design requirements. Therefore, even if the metal bezel 200 is squeezed and the metal bezel 200 is electrically connected with the metal frame 100 at more electrical connection points, which is equivalent to increasing the number of the electrical connection points on the basis of this implementation, the performance of the antenna is not affected and the above effects described in this implementation can still be achieved based on the above principle.

However, it is worth noting that one of the technical solutions of the implementations of the present disclosure is to set the distance between any two adjacent connectors along the first direction to be less than ¼ of the wavelength corresponding to the maximum operating frequency of one or more antennas. In other words, no matter how many antennas with different operating frequencies are included in the device, as long as it is guaranteed that the antenna with the maximum operating frequency meets the design requirements, the rest of the antennas can meet the requirements.

For example, the wearable device may further include a 4G LTE antenna with an operating frequency ranging from 0.7 GHz to 2.69 GHz, a WiFi 5.8 GHz antenna, a 5G n77 antenna with an operating frequency ranging from 3.3 GHz to 4.2 GHz, etc. The distance between any two adjacent connectors is made less than ¼ of the wavelength corresponding to the maximum operating frequency by increasing the number of the connectors, and the type and operating frequency of the antenna are not limited. This can be understood by those skilled in the art, and will not be repeated in the present disclosure.

After the operating principle of the implementations of the present disclosure is explained above, the specific implementations of the connector will be described in detail below.

The smart watch shown in FIG. 1 is still taken as an example. As shown in FIG. 2, the metal frame 100 is fastened to the metal bezel 200 by an assembly boss. For example, an annular assembly step is provided around the metal frame 100, and a lug is formed around an edge of the metal bezel 200, so as to achieve the assembly of the metal bezel 200 and the metal frame 100 via the fit between the lug and the assembly step. An assembly gap between the metal bezel 200 and the metal frame 100 needs to be filled with an insulating adhesive to form a filler structure. The filler structure may insulate the metal bezel 200 from the metal frame 100 on the one hand, and may bond and fix the metal bezel 200 to the metal frame 100 on the other hand.

On this basis, the connector in the implementations of the present disclosure may be provided in the gap where the metal bezel 200 abuts against the metal frame 100, and an electrical connection point is formed through the connector to electrically connect the metal bezel 200 and the metal frame 100.

Figure 9A:
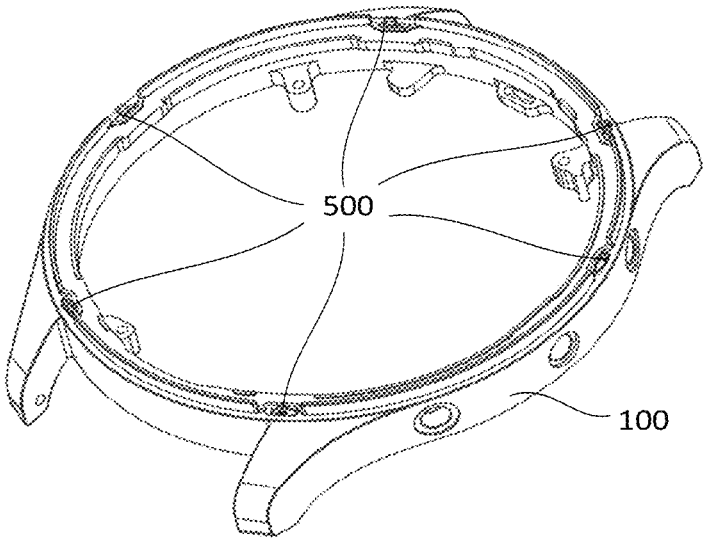
FIGS. 9A and 9B are schematic structural diagrams illustrating a connector according to some implementations of the present disclosure.
Figure 9B:
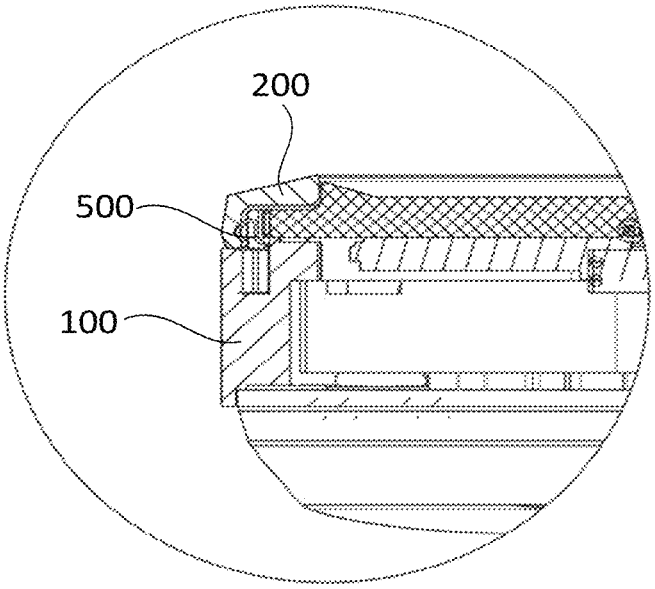

In an example, as shown in FIGS. 9A and 9B, the connectors 500 include six metal spring pieces uniformly disposed on the metal frame 100. For example, six assembly holes are provided in the metal frame 100, and each of the metal spring pieces is mounted in a respective assembly hole. One end of the metal spring piece is fixed in the assembly hole, and the other end of the metal spring piece abuts elastically against an inner wall of the lug of the metal bezel 200. This electrical connection method is applicable to the metal frame 100 made of material such as titanium alloy or aluminum alloy which is difficult to weld.

Figure 10A:
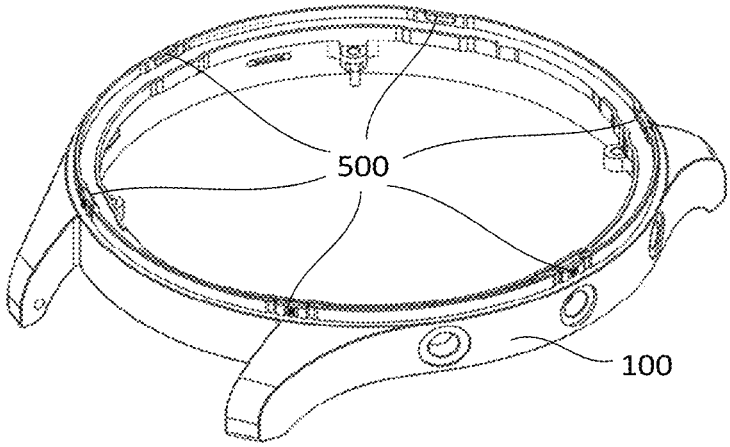
FIGS. 10A and 10B are schematic structural diagrams illustrating a connector according to some implementations of the present disclosure.
Figure 10B:
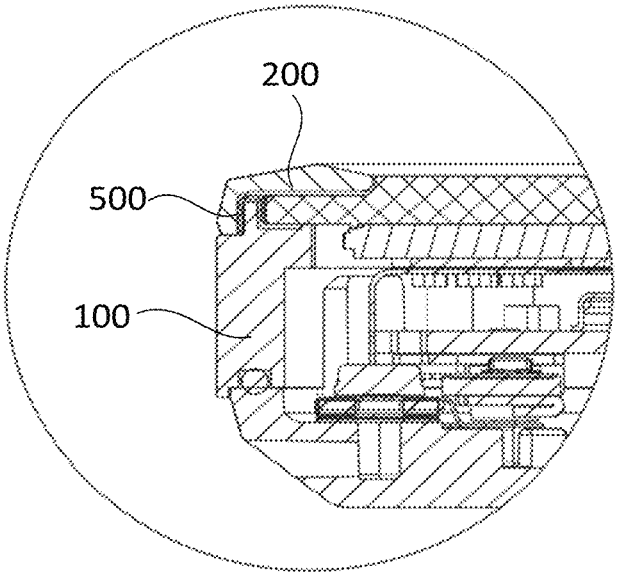

In another example, as shown in FIGS. 10A and 10B, the connectors 500 also include six metal spring pieces uniformly disposed on the metal frame 100. FIGS. 10A and 10B differ from FIGS. 9A and 9B in that, one end of the metal spring piece is fixedly connected to the metal frame 100 by welding, and the other end of the metal spring piece abuts elastically against the inner wall of the lug of the metal bezel 200. This electrical connection method is applicable to the metal frame 100 made of material such as stainless steel which is easy to weld.

In this implementation, the metal spring piece exerts an elastic force on the metal bezel 200 in a radially outward direction of the watch, such that the metal spring piece may also exert a radially outward force after the metal bezel 200 is assembled with the metal frame 100, making the metal bezel 200 assembled more firmly, while making the electrical connection between the metal bezel 200 and the metal frame 100 more stable.

Figure 11A:
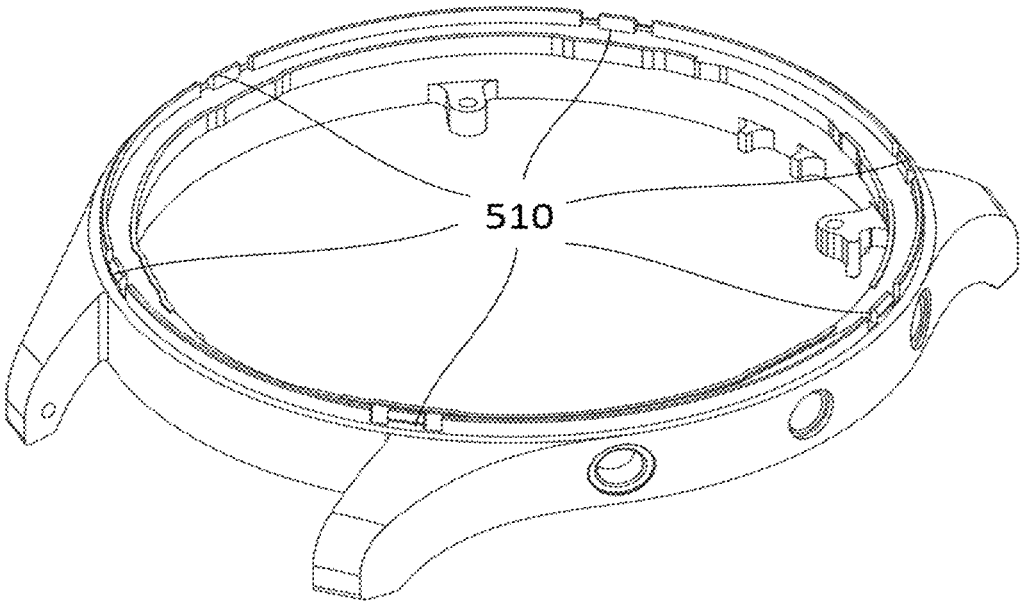
FIGS. 11A and 11B are schematic structural diagrams illustrating a connector according to some implementations of the present disclosure.
Figure 11B:
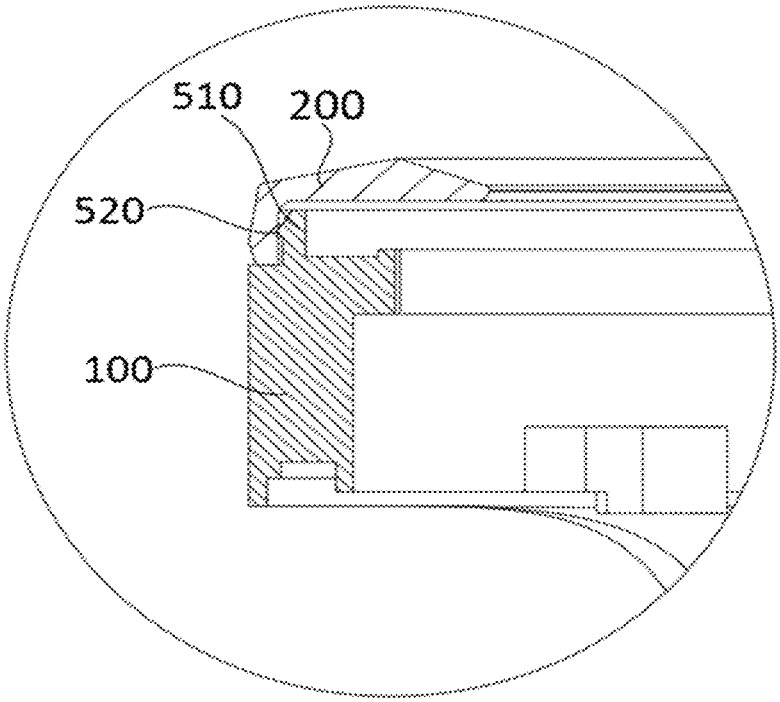

In alternative implementations, the structure of the connector is shown in FIGS. 11A and 11B. The connector is a snap 510 integrally formed on the assembly step of the metal frame 100, and six snaps 510 are uniformly distributed around the circumference of the metal frame 100. A protrusion 520 is formed on a side wall of the snap 510 facing the lug of the metal bezel 200, such that the protrusion 520 abuts against the inner wall of the lug of the metal bezel 200 after the metal bezel 200 is assembled with the metal frame 100 to achieve the electrical connection between the metal bezel 200 and the metal frame 100. This electrical connection method is applicable to the metal frame 100 made of any metal material.

However, in addition to the above examples, the structure and setting of the connectors may be in any other form suitable for implementation, which can be understood by those skilled in the art and will not be enumerated in the present disclosure.

Further, in the implementations of the present disclosure, although the wearable device is described by taking the smart watch as an example, the wearable device in the present disclosure is not limited to the smart watch, but may be any other wearable device suitable for implementation, which is not limited in the present disclosure.

As can be seen from the above, with the wearable device according to the implementations of the present disclosure, the metal bezel 200 and the metal frame 100 are electrically connected to each other through the plurality of connectors provided between the metal bezel 200 and the metal frame 100, such that the metal bezel 200 is electrically connected to the metal frame 100 at predetermined positions to ensure the consistency of the antenna, and the performance of the antenna is not affected even if some additional electrical contact points may be created between the metal frame 100 and the metal bezel 200 at uncertain positions during use. Moreover, the distance between any two adjacent connectors along the first direction is less than ¼ of the wavelength corresponding to the maximum operating frequency of the one or more antennas. Since the length of the gap for generating electromagnetic wave resonance is required to be at least ¼ of the resonant wavelength, if the distance between any two adjacent connectors is less than ¼ of the wavelength corresponding to the maximum operating frequency of the antennas, clutter interference can be effectively avoided and the radiation performance of the antenna can be greatly improved.

It is apparent that the above implementations are merely examples for clarity of description, and are not limitations on the implementations. For those ordinary skilled in the art, other variations or modifications in different forms may be made based on the above description. It is not necessary or possible to exhaust all implementations herein. However, obvious variations or modifications derived therefrom still fall within the protection scope of the present disclosure.

What is claimed is:

1. A wearable device, comprising:

a metal frame provided on a side of the wearable device, wherein one or more antennas are formed by: the metal frame, a gap between the metal frame and a mainboard of the wearable device, and the mainboard comprising a feeding module and the metal frame comprising a grounding point; and a metal bezel provided on a front edge of the wearable device, the metal bezel and the metal frame being electrically connected to each other through a plurality of connectors, a distance between any adjacent two of the plurality of connectors along a first direction being less than ¼ of a wavelength corresponding to a maximum operating frequency of the one or more antennas of the wearable device, and the first direction being a peripheral direction of the metal frame, wherein an assembly step is provided on a side edge of the metal frame close to the metal bezel, a lug protruding toward the metal frame is formed on an edge of the metal bezel, and the metal bezel is provided on the assembly step of the metal frame through the lug.

2. The wearable device according to claim 1, wherein the plurality of connectors are arranged uniformly along the first direction.

3. The wearable device according to claim 1, wherein an insulating filler structure is filled between the metal frame and the metal bezel.

4. The wearable device according to claim 1, wherein the one or more antennas of the wearable device comprise at least one of:

a Bluetooth antenna, a satellite positioning antenna, a WiFi antenna, an LTE antenna, or a 5G antenna.

5. The wearable device according to claim 1, wherein each of the plurality of connectors is a metal spring piece, one end of the metal spring piece is fixed to the metal frame, and the other end of the metal spring piece abuts elastically against an inner wall of the lug of the metal bezel.

6. The wearable device according to claim 5, wherein the metal frame is provided with a plurality of assembly holes, and the one end of the metal spring piece is fixed in a corresponding assembly hole.

7. The wearable device according to claim 5, wherein the one end of the metal spring piece is welded to the metal frame.

8. The wearable device according to claim 1, wherein each of the plurality of connectors is a snap integrally formed on the assembly step, and a protrusion that abuts against an inner wall of the lug is formed on a side of the snap facing the lug of the metal bezel.

9. The wearable device according to claim 1, wherein the wearable device is a smart watch or a smart wristband.

10. The wearable device according to claim 1, wherein the distance between any adjacent two of the plurality of connectors along the first direction is less than 30 mm.

11. The wearable device according to claim 1, wherein the plurality of connectors comprise a minimum number of connectors that satisfy a condition that the distance between any two adjacent connectors along the first direction is less than ¼ of the wavelength.

12. The wearable device according to claim 1, wherein the plurality of connectors comprise six connectors.

13. The wearable device according to claim 1, wherein the antenna is a positioning antenna.

14. The wearable device according to claim 1, wherein the first direction is a circumferential direction of the metal frame, and the distance between two adjacent connectors along the first direction is a corresponding arc length between the two adjacent connectors.

15. The wearable device according to claim 1, wherein the metal frame comprises an annular metal frame, and the metal bezel comprises an annular metal bezel.

16. The wearable device according to claim 1, wherein the plurality of connectors are uniformly distributed along the first direction.

17. The wearable device according to claim 1, wherein the plurality of connectors are not uniformly distributed along the first direction.

18. The wearable device according to claim 1, wherein the antenna comprises a slot antenna formed by the metal frame, the mainboard and the gap between the metal frame and the mainboard.

19. The wearable device according to claim 1, wherein the antenna is further formed by the plurality of connectors electronically connecting the metal bezel and the metal frame to each other.

* * * * *